United States Patent [19]

Cousin et al.

[11] Patent Number: 4,533,111

[45] Date of Patent: Aug. 6, 1985

[54] CONSTRUCTION SYSTEM FOR CAST-IN-PLACE CONCRETE BARRIERS FOR ROADWAYS

[76] Inventors: Charles M. Cousin, 3909 Ames Blvd., Marrero, La. 70072; Frederick H. Gondrella, Sr., Rte. 1, Box 451F, Belle Chasse, La. 70037

[21] Appl. No.: 428,528

[22] Filed: Sep. 30, 1982

[51] Int. Cl.[3] ..... E01C 7/00

[52] U.S. Cl. ..... 249/2; 249/8; 249/9; 249/84

[58] Field of Search ..... 249/2, 129, 84, 86, 249/8, 9; 425/111

[56] References Cited

U.S. PATENT DOCUMENTS

| | | | |
|---|---|---|---|
| 765,424 | 7/1904 | Griggs | 249/84 |
| 3,052,945 | 9/1962 | Cummings | 249/9 |
| 3,589,664 | 6/1971 | Middlestadt | 249/9 |

*Primary Examiner*—Donald Czaja
*Assistant Examiner*—Mary A. Becker
*Attorney, Agent, or Firm*—C. Emmett Pugh & Associates

[57] ABSTRACT

A system for constructing concrete barriers on a roadway with adequate spacing between sections of the barrier for proper drainage and expansion of the concrete during changing atmospheric conditions. The process utilizes a specially designed positioning tool to leave a proper space in a latice framework of steel rods. A temporary, removeable core or separating section, made of for example a styrofoam inner layer sandwiched between outer layers of "Masonite," designed for this purpose and matched with the positioning tool is inserted into the space and secured there using pins attached to the metal latice works providing an unbroken, constant surface or mold on which to pour concrete for the barrier. When the concrete has set, the core may be collapsed without damaging the concrete or metal frame and removed. When the various cores are removed, the barrier is left with properly spaced and positioned gaps for drainage and expansion of the concrete. In constructing the metal framework as a mold for the concrete, the invention provides a means for assuring that the metal rods are of even height so that the barrier is esthetically and functionally symetrical. This is accomplished by using an acetylene torch to cut off the rods at the proper height. The torch is held at the proper distance above the floor of the roadside or bridge on which the barrier framework is set by means of a clamp affixing the torch at a fixed height onto a metal rod which rests on the ground or existing prepoured concrete slab. In pouring the concrete, the invention provides for an unobtrusive but effective guide for machines pouring concrete. This is accomplished by using sections of pipe, contact attached, mounted on height adjustable plates.

6 Claims, 9 Drawing Figures

CONSTRUCTION SYSTEM FOR CAST-IN-PLACE CONCRETE BARRIERS FOR ROADWAYS

BACKGROUND OF THE INVENTION

1. Field of Invention

The invention relates to on-site construction of concrete barriers for roadways. More specifically, the invention relates to the construction of concrete barriers with a steel reinforced frame using collapsable separating members or "cores," which, when collapsed, can be easily removed from the barrier. By removing the "cores," spaces are left in the otherwise continuous barrier of the size and shape of the "cores," which allow for water to properly drain and for the concrete to expand or contract without breaking during changing atmospheric conditions.

2. History and Prior Art

When building or repairing roads or bridges, it is desirable to have concrete barriers in certain places on the roadside to prevent cars from leaving the right-of-way. This is particularly true where the barriers protect bridges or curving right-of-ways or where the barriers are set up to protect workers on a road or bridge just off the right-of-way. Concrete barriers are also used to separate traffic lanes.

It is necessary that such barriers be constructed of sufficient strength to withstand the impact of a swerving vehicle. It is also necessary that the barriers be durable enough to withstand the elements over a long period of time so that the need for repairs is eliminated. To meet these demands, barriers are commonly constructed of concrete with internal steel frames for strength. Because these barriers are heavy and difficult to handle, it is efficient to build them at the location at which they are used rather than to manufacture them and subsequently place them at the construction site.

When building concrete barriers, two important considerations are that the barriers allow for proper drainage of water from the protected roadway, and that the barrier be sufficiently sectioned, with the sections spaced so as to allow for expansion and contraction of the concrete without their cracking due to changing atmospheric conditions. The present invention relates to an efficient and inexpensive method providing for these considerations.

Constructing barriers to discrete sections can be inefficient. The discrete sections must be individually placed and, as a result, may not, therefore, be perfectly aligned or separated. The operation of pouring concrete must be started and ended for each section, wasting time in starting and stopping, forcing longer use of the vehicle pouring the concrete and creating confusion as some workers are required to finish up a poured section, while other workers begin pouring concrete over the new section. Likewise, construction of the barriers as a single, unbroken unit is impractical with the prior art, due to the difficulty in cutting out proper spacing for drainage and expansion without prohibitive costs or damage to the cement matrix. The present invention provides for the pouring of a continuous barrier but eliminates the need for cutting thru the barrier subsequent to its completion. It also provides for precise placement of the spacing. The present invention saves time required by the construction of discrete sections and saves costs in labor and decreases interference with normal traffic use of the roadway being developed. Quick construction is an essential safety factor where the barriers are built on a right-of-way, to protect workers just off of the right-of-way. The present invention, which directs itself to the problem of proper separation of sections of such a concrete barrier, also provides a techniques for the quick and efficient construction of the barrier.

Various techniques have been developed for causing spaces to be formed in concrete for the purpose of for example allowing expansion due to changing atmospheric conditions or drainage or to form a hollow core. Spacing of concrete portions of roadbeds for allowing expansion of the section has been accomplished for example by inserting collapsable wedges into for example wet concrete. These wedges are then removed by removing an inner wedge and pulling the now loosened, outer wedge from the hardened concrete. See for example U.S. Pat. No. 3,052,945 (issued 9/11/62 to Cummings). U.S. Pat. Nos. 955,235 (issued 4/19/10 to Wellman), 3,677,688 (issued 6/18/72 to Morgan), and 3,694,531 (issued 9/26/72 to Glass) used collapsable cores set in wet concrete in order to form hollows in concrete blocks or wall structures. U.S. Pat. No. 1,120,534 (issued 12/18/14 to Rigby) used a similarly collapsable core to provide a mold for rope guides which is removed after hardening of the poured metal by collapsing the core. In each of these prior patents, the collapsable core is collapsed by removing a center part of the core or in U.S. Pat. No. 3,694,531 by using the action of a centrally located hydraulic jack to collapse the exterior, obliquely located sides of the collapsable core.

In U.S. Pat. No. 3,421,551 issued 1/14/69 to Currier) polystyrene expanded plastic foam or styrofoam was used in order to reserve spaces in poured concrete for pipe sleeves. This material was used because its high compressive strength allowed it to withstand the pressure of the poured concrete while being readily breakable or fungible so that it could be cut out. The high compressive strength as well as non-absorbent quality of styroform or other polyurethane or similar plastic material has also led to its use in forming molds for concrete construction in U.S. Pat. Nos. 3,350,049 (issued 10/31/67 to Reiland), 3,515,779 (issued 6/02/70 to Jones), and 3,689,021 (issued 9/05/72 to Liester). Reference is also had to the German Offenlegungsschrift No. 1,409,829 with an "anmeldetag" of 9/08/60.

The present invention envisions the use of a removeable core which utilizes an internal or inner core layer of a fungible material of high compressibility such as polystyrene expanded plastic foam in order to facililate collapsing and removal of the collapsable core. The core is used in order to provide the spacings between sections of concrete barriers whose construction is the object of the present invention.

The construction of concrete barriers reinforced with steel rods is well known in the art. Standard steel rods and machines for welding these together and for pouring concrete are available with existing materials and technology. Also in the existing art are torches, such as acetylene, for cutting or heating to shape the steel rods, as are arc and spot welding machines to connect or weld them together.

The general technique embodied in the present invention of generally building a metal latice and using this latice as a frame for supporting the poured concrete is also known in the art.

Various techniques have also been developed for holding acetylene torches and guiding them. See U.S. Pat. Nos. 988,950 to Rossell of Apr. 4, 1911; 2,170,305 to Inquersen of Aug. 22, 1939; 2,523,237 to Richardson of Sept. 19, 1950; 3,139,471 to Root of June 30, 1964; 2,596,133 to Donahue of May 13, 1952; 3,494,586 to Haynes of Feb. 10, 1970; 2,514,741 to Bullman of July 11, 1950; 895,026 to Jottrand and Lulli of Aug. 4, 1908; 1,553,508 to Cloud of Sept. 15, 1925; 2,291,199 to Anderson of July 28, 1942; and 3,350,540 to Andre of Oct. 31, 1967. The device for cutting metal at a fixed height of the barrier frame utilized in the present invention is generally considered only a secondary part of the invention as used in the present invention.

Concrete for cast-in-place barriers may be poured by machines well known in the prior art. These machines may be guided by electronically controlled aluminum arms which run along and are guided by a surface provided for this purpose. These arms are also known in the prior art.

In the past, concrete pouring machines have used strings tightly strung between rods placed in the earth as guides for pouring the concrete. The height of these strings is often inconvenient in that it interfers with workers operating on either side of the string. Additionally, it is often inconvenient to place rods in an unyielding or fragile surface, as when the concrete is being poured on a concrete slab as with the construction of bridge barriers. To remedy these problems, the present invention envisions the use of sections of pipe which plug together to form a continuous guide line along the ground. These pipes may be mounted on plates which are in turn mounted on bolts, so that the height at which they sit may be adjusted in order to be at the proper height to guide the pouring of concrete. These pipes may be so low along the ground that they do not impose much of a barrier to workers who pass on either side of the guide. Additionally, by sharpening the bolts on which these pipes ultimately rest, the guide becomes sufficiently secure along the ground so that it is unnecessary to drive rods into the ground, which is often unyielding concrete.

3. Summary Discussion of the Invention

The present invention provides a quick and efficient method for building barriers on-site with concrete.

It also provides for building a frame of steel rods which are evenly cut for the pouring of concrete.

It also provides a frame which contains properly located gaps into which removeable spacing sections or "cores" are inserted. When these cores are collapsed and removed after the concrete has been poured and allowed to set, these gaps provide spaces in an otherwise solid barrier for drainage of water and expansion of the concrete sections. These gaps are bounded by steel pins running laterally and parallel to the roadgrade. The rods may be capped with plastic tips, which may be attached to further ease the correct insertion and positioning of the "cores". The frame so designed is the major part of the invention. It provides that the spacing section may be placed in their respective locations in the frame quickly and immediately before concrete is to be poured, so as to prevent their being removed. Especially this prevents the cores from being thrown over the sides of bridges where the barriers are to be placed.

It provides for separating pieces which, when assembled, are of the same width as the gaps desired to be left within the concrete barriers. It also provides that these separating pieces have a central inner layer of fungible materials, which when cut out or hammered out will leave a space between the outer hard walls of the separating pieces into which space the outer pieces may be collapsed and subsequently removed, leaving a gap of the desired width behind.

This removeable, spacing core preferably includes a sandwich structure having an inner layer of fungible material (for example styrofoam or other plastic foam material) and outer, facing layers of hard material (for example "Masonite" and plywood or metal).

It also provides for x-bracing of the metal frames where the gaps are to be left in order to provide these points with additional strength and resilience as the end pieces of the respective sections of the barrier.

It also provides for a specially designed, positioning tool which may be used in order to assure that the gap left for the "cores" is at the correct angle to the road grade and that the gap be of the correct width and shape. This positioning tool is constructed in the form of a rectangular shaped box of the same width as the separating "core" pieces.

In the present invention, a matrix framework of steel bars is made by setting the steel bars into the bridge or roadside surface in concrete, and then connecting these bars thru welds to bars running laterally and perpendicularly to the bars set in the roadside. Likewise, the invention contemplates the use of steel rods and from the steel rods reinforcing a road or bridge bed to form the perpendicular part of the barrier frame. These bars may be properly shaped and aligned by using a prefabricated, wooden pre-frame in the shape of the metal, reinforcing frame to be built, where wooden x-members correspond in height and are located in just a position to where the metal rods are to be placed. This pre-frame may be of such design that the metal frame may be built within the wooden frame and after the metal frame is completed, the wooden frame may be lifted over the metal frame without requiring disassembly.

The present invention then provides that the metal bars perpendicular to the road surface be cut off at the same height from the road surface by means of an acetylene torch affixed at the desired height on a ringstand. The base of the ringstand rests on the surface and is perpendicular to the ringstand rod itself and parallel to the surface of the roadside or bridge on which it rests. The torch is held in place by holding members, such as screw clamps, which hold the blow torch tip to the rod of the ringstand. The entire arrangement may be quickly and easily moved from one steel rod to the next without detaching the blowtorch from the ring stand rod, so that the cutting process procedes with dispatch. It is desired that the steel rods all be at the same height so that the steel rods will not interfere with the pouring of concrete at a set and certain height and so that the mold on which the concrete is poured will be even.

The present invention also provides for a line of contact connectable pipe which rests on plates which in turn rest at an adjustable height on top of bolts. This line of pipe provides a guide for the concrete pouring machinery. Because the pipe rests on bolts, it is unnecessary to drive rods into the often unyielding surface below the guides in order to keep the guide in place at the proper height. Because the pipe is contact connected, it may be easily placed and removed. The bolts may have the ends which rest on the surface sharpened in order to make their contact with the surface more secure. This line of pipe may rest at a low height so as not to interfere with the movement of workers on either side of the guide.

BRIEF DESCRIPTION OF THE DRAWINGS

For a further understanding of the nature and objects of the present invention, reference should be attached to the following detailed description taken in conjunction with the accompanying drawings, in which like parts are given like reference numerals and wherein.

DETAILED DESCRIPTION OF THE PREFERRED EMBODIMENT

Figure 1:
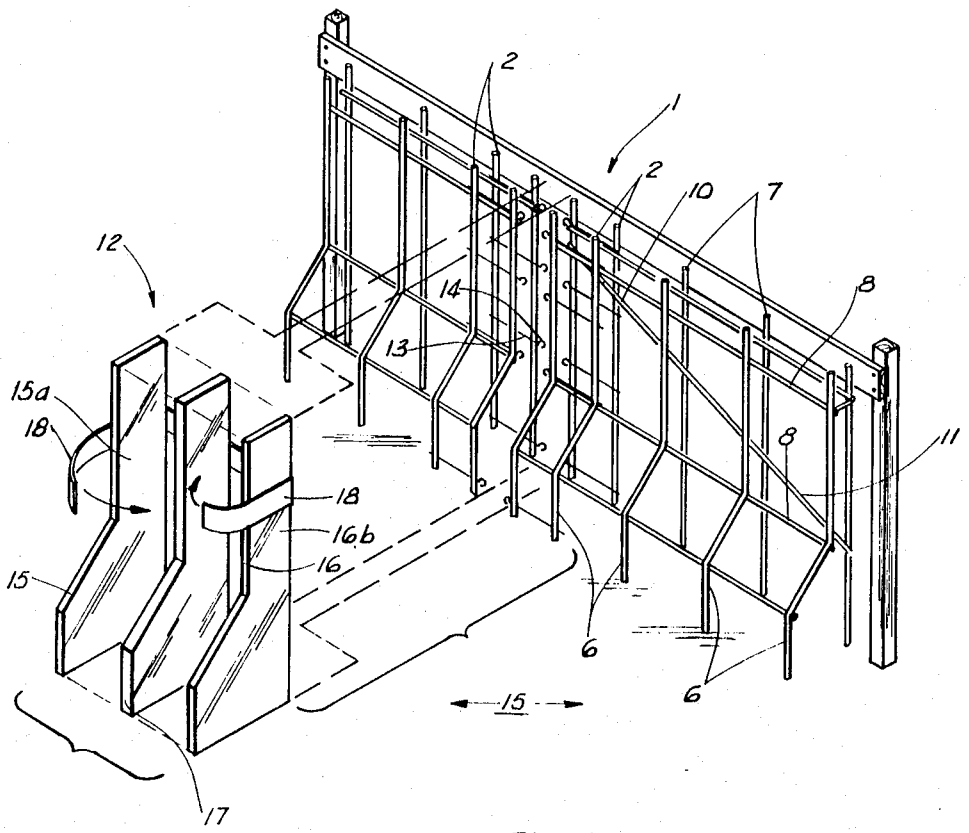
FIG. 1 is an exploded, sectional, perspective view showing the removeable core used for leaving gaps between sections of the concrete barrier exploded out from the part of the metal frame into which the collapsable core fits.

FIG. 1 illustrates the preferred embodiment of a section of the reinforcing frame 1 for the present invention. The reinforcing frame 1 serves as a mold or frame over which the concrete jacket for the barrier may be poured.

The metal frame shown generally at 1 is made up of steel rods 6 and 7 set in a concrete floor 3 on the road 4 where the barrier is to be erected. The steel rods 6, 7 typically are standard half inch steel round rods. The steel rods 6 and 7 are set parallel to each other and perpendicular to the grade of road 4. The steel rods 6 and 7 are spaced at a predetermined distance from each other according to the amount of support which the rods 6 and 7 are to give to the concrete jacket. This separation distance may be for example six inches where the gap 5 is to be left. Additional vertical steel rods 2 are set at a shorter distance between each other in order to provide additional support in the vicinity of the frame where the barrier is to be left open for drainage and expansion at gap 5 and are so placed on either side of gap 5.

Two rows of vertical rods 6 and 7 are provided. One row of rods 6 runs parallel to the road right of way 15 and between road right of way 15 and the second row of rods 7. The row of rods 6 closest to the road right of way 15 is designated as the front of the barrier frame. The rows of rods 7 behind the rods 6 relative to the road right of way 15 are designated as the rear of the barrier frame.

The steel rods may be bent into the desired shape of the barrier by mechanical means known in the art. Here the steel rods 6 have been bent into a "boot" shape, and steel rods 7 have been left unbent. This configuration is shown for convenience and the invention contemplates any shape which the barrier is desired to have.

This vertical part of the frame of steel rods 6 and 7 may be buttressed by laterally running steel rods 8 running generally parallel with the roadgrade and perpendicularly to the steel rods 6 and 7 which form the vertical front and rear part of the frame. These laterally running steel rods 8 are welded consecutively to the steel rods 6 at the barrier frame front and consecutively to the steel rods 7 at the rear of the frame barrier at points 9 where steel rods 6 or 7 intersect with steel rods 8.

Still further support may be provided by cross-braces in the vicinity of the frame where the gap 5 is to be left by braces 10. These cross-braces 10 are steel rods welded at an angle of approximately forty-five degrees to the road guide welded at points of intersection 11 with the steel rods of the front 6 or rear 7 of the barrier frame. Here only steel rods 7 on the rear of the barrier frame are reinforced by x-bracing, however this technique may be used at both the rear and front of the barrier frame.

The gap 5 in the barrier framework be left when building the frame or may be built into the frame by cutting out the metal rods 6 and 7 in the vicinity where the gap 5 is to be left. The gap 5 will contain the collapsable core 12, which core 12 is a part of frame which will be removed after the concerte is poured and sets. When core 12 is removed, an adequate space will be left between the sections of the barrier for drainage and expansion.

The collapsable core shown generally as 12 is held perpendicularly to the grade of the road and parallel to the vertical rods 6 and 7 of the barrier frame by steel pins 13 which may have plastic caps 14. These steel pins 13 may be standard quarter inch round steel pins approximately a foot and a half in length. These steel pins 13 are attached to the front barrier frame rods 6 and the rear barrier frame rods 7 so that they extend a predetermined distance into the gap. This distance is determined by a method described with reference to FIG. 1*a*. The distance between steel pins 13 on one side of the gap from those pins on the other side of the gap corresponds to the width of the collapsable core 12. In this way, collapsable core 12 may be firmly set between pins 13 into the barrier frame.

Collapsable core 12 is of simple and inexpensive construction and includes an inner core 17 between two outer walls 15 and 16. The inner surface 15*a* and 16*a* of outer walls 15 and 16 respectively rest against the opposing faces of inner core 17. Outer surface 15*b* and 16*b* of outer walls 15 and 16 rest against plastic caps 14 which are mounted on the steel pins 13. Clearances are such that the collapsable core 12 may be easily inserted into the barrier frame 1 at gap 5 immediately before pouring the concrete over the barrier frame, so as to prevent the loss of the core between the time when the frame is built and the concrete poured.

The outer walls 15 and 16 may be made of any material which can withstand the pressure of the concrete when it is poured. This material for the walls and whose outer surfaces face the concrete as it is poured may be steel or plywood. For the outer wall whose outer surface faces away from the concrete as it is poured, this outer wall may be made of the same materials or a less strong material such as Masonite.

Inner core 17 may be made of any fungible or breakable material with a high compressibility factor such as styrofoam. In this way the inner core 17 may be cut out for removal. Alternatively, the inner core 17 may be made of steel and may be hammered out for removal and reused. A metal inner core 17 may be equipped with handles to facilitate this removal. The inner core 17 must have high compressibility so as to maintain its volume against the pressure of the concrete which is poured over the entire frame 1. The entire core 12 is bound by adhesive tape 18 at the top to prevent the parts from sliding when concrete is poured over the frame and core. (The core is inserted into the rest of the frame between pins 13.) Concrete is then poured over the entire frame using a method known in the art.

When the concrete has dried, the inner core 17 is cut out or hammered out. The two outer walls 15 and 16 are then pulled away from the now dry concrete walls and plastic tipped metal pins 13 toward each other and "collapsed" into the space left by the removal of inner core 17. The entire core is thereby removed, leaving a gap which corresponds in size to the collapsable core for expansion and drainage between sections of the concrete barrier.

Figure 1A:
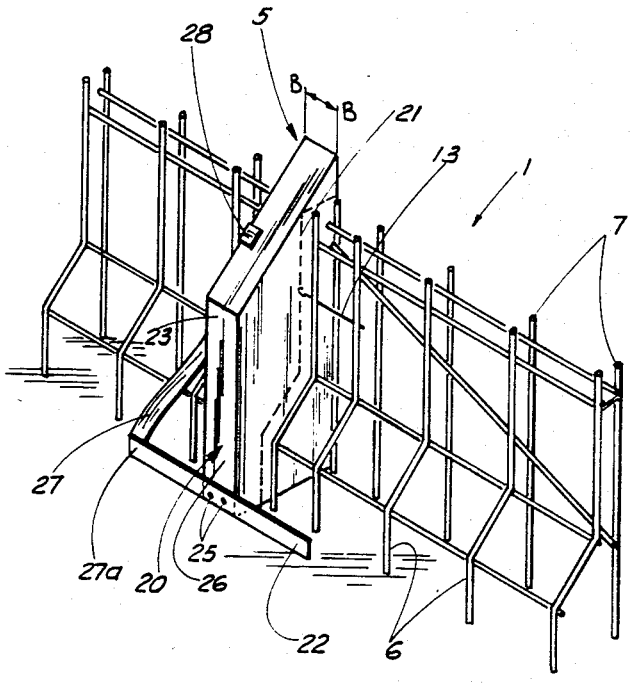
FIG. 1*a* is a perspective view similar to FIG. 1, but with the spacing core in position.

FIG. 1*a* shows the special positioning tool designed to properly set the distance between pins 13 on the barrier frame 1 at gap 5. The width of this tool indicated at B—B corresponds exactly to the width of the collapsable core 12 which will be placed between the pins 13 in gap 5.

The initial gap 5 in the barrier frame 1 may be cut approximately using this tool as a guide or without using this tool. The tool shown generally as 20 is then inserted in the gap 5. As shown an outline of the outer-face of collapsable core 12 is drawn on either face of the tool 20 as shown by the dotted line at 21 to facilitate placement of the tool in gap 5.

After the tool 20 has been properly inserted in gap 5, pins 13 may be welded to the barrier frame 1. Here a single pin 13 is shown welded onto the frame. The positioning of these pins 13 is aided by the outline of the collapsable core which is drawn on the face of the tool 20*a* as shown by the dotted line at 21. The pins are set against the tool face 20*a* at the outline 21 and welded into place on steel rods 6 and 7. When the tool 20 is removed, the pins are thus left in the gap 5 at an appropriate distance from each other corresponding precisely to the width B—B of tool 20. Tool 20 is removed after pins 13 have been properly aligned so that the collapsable core 12 may be slid in between the pins 13 on either side of gap 5 and held there by the pins 13 snugly.

There may be five pins of the front steel bars 6 and five pins on the rear steel bars 7 welded to said bars on either side of gap 5. This number may be greater or less depending on the amount of force these pins 13 are required to provide in order to support the collapsable core 12 during the construction process.

The positioning tool includes a rectangular piece 23 with a width as shown at B—B, which corresponds to the width of the collapsable core 12 which is to be placed after the tool 20 has been used to set pins 13 and removed. The tool has an outline 21 drawn on either face to facilitate setting it in position and positioning pins 13. The tool has a parallel band of steel 22 which is attached to the rectangular piece 23 at its base 24 by screws 25 or by welds. The steel band 22 is perpendicular to the face 26 of the rectangular piece 23 which faces out from the frame to which it is attached and parallel to the road on which it sits. Hence, the rectangular piece 23 is held perpendicular to the grade of the road at all time for placing pins 13 by metal band 22. An additional steel band 27 may be run from the top and center of the rectangular section 23 shown at 28 to the end of the other steel bank 22 shown at 27*a*. Here, steel band 28 may be welded or bolted to steel band 22 in order to sturdy the support provided by band 22. These steel bands may each be inch by quarter inch steel.

Figure 2:
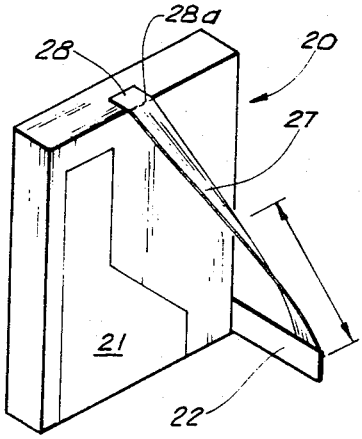
FIG. 2 is a perspective view of the alignment tool used to properly cut out a space for the collapsable core and to place the plastic tiped pins on the lateral reinforcing rods which will hold the core in place.

FIG. 2 shows the other face of positioning tool 20. Here at 21 the boot shaped outline of the collapsable core is more clearly shown on this other face. The connection of the steel band 27 at the top and center of the rectangular section 23 is shown here at 28. A bend 28*a* is provided in the metal band, and the band is twisted ninety degree and bent at an angle of forty-five degree between the points indicated at "c—c" in order to have the other end of band 27 meet the end of band 22 at 28, where the bands 22 and 27 are joined by welds or bolts.

Figure 3:
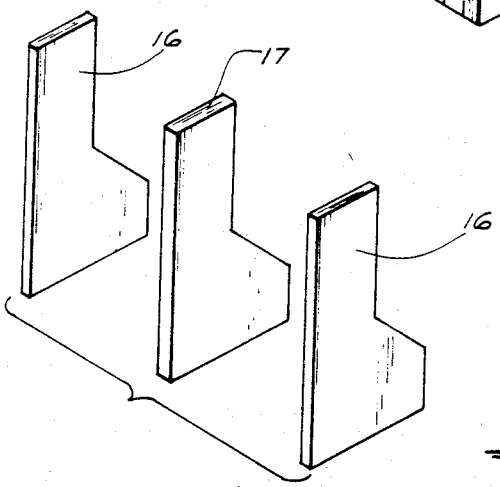
FIG. 3 is an exploded perspective view of one embodiment of the collapsable core. In this embodiment the core has a "boot" shape.

FIG. 3 shows the three sections of the collapsable core 12.

Figure 4:
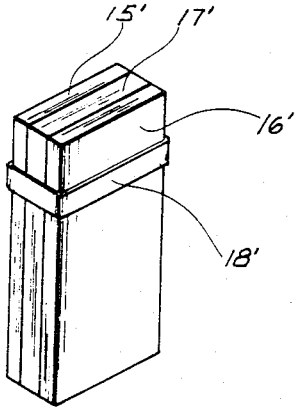
FIG. 4 is a perspective view of another embodiment of the collapsable core. In this view, the core is shown assembled.

FIG. 4 is an alternative embodiment of the core 12 cut into a rectangular shape. Note the three sections are bound at the top by tape 18.

Figure 5:
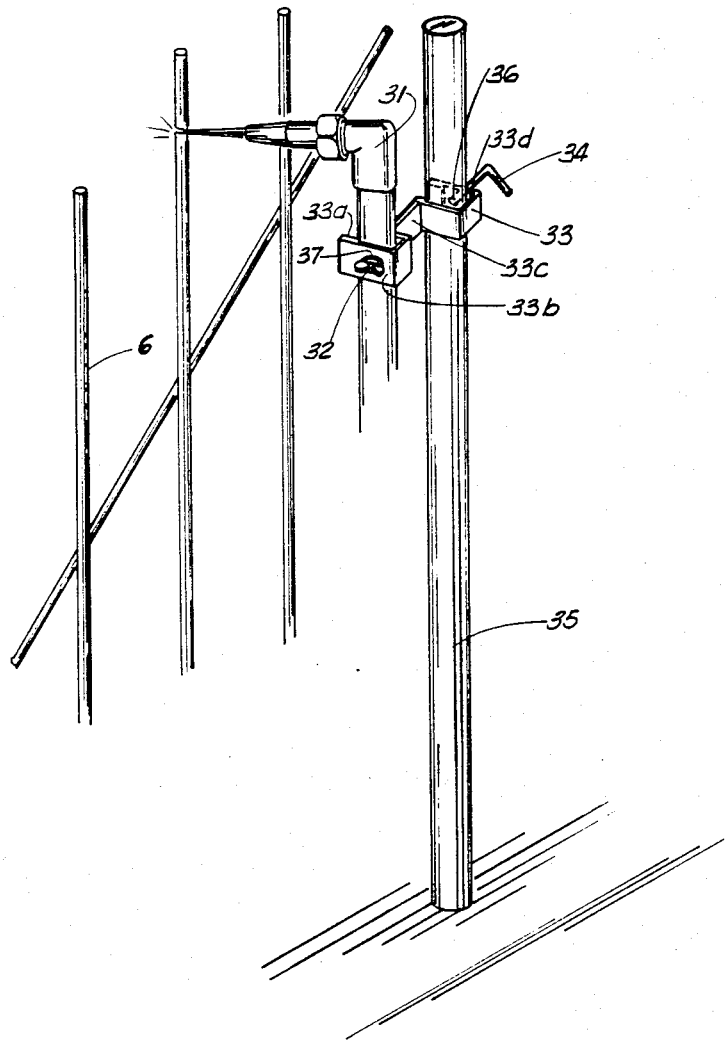
FIG. 5 is a perspective view of the apparatus used for cutting off the steel rods at a uniform height.

FIG. 5 shown the technique used for assuring that the steel rods 6 and 7 comprising the vertical front and rear of the barrier frame are cut off at the same height to facilitate construction.

Cutting torch 31 is held in place by means of pressure applied between bolt 32 and body portion 33. Bolt 32 in turn is mounted in body portion 33. The body portion 33 consists of two raised ends 33*a* and 33*b*. In 33*b* a threaded hole has been reserved to hold winged bolt 32. Opposite the two raised ends and centered in that part of the body portion is another body part 33*c* which also has a raised end 33*d* with a threaded hole to receive handle bolt 34. Handle bolt 34 applies pressure to secure ring stand bar 35 tightly against body portion 3 at a predetermined fixed height. This fixed height corresponds to the height at which the steel rods 6 and 7 are to be cut. Ring stand bar 35 rests without additional support on the road beside the barrier when cutting.

Figure 6:
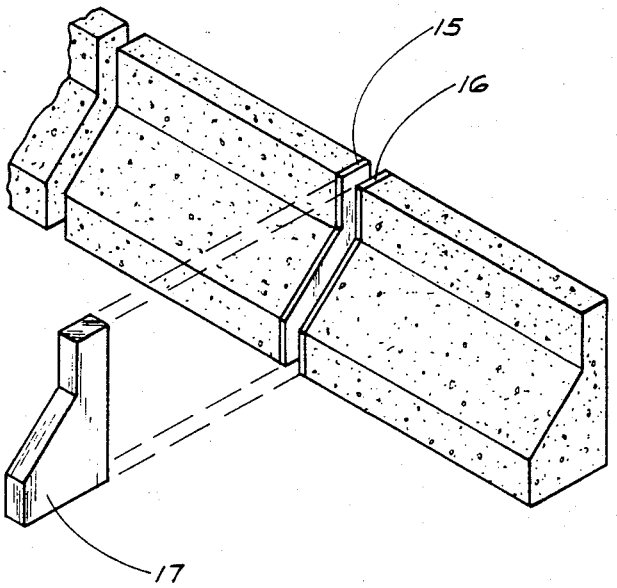
FIG. 6 is a perspective, sectional view of the concrete barrier showing a completed section with the core removed and a section with only the central member of the core removed.

FIG. 6 shows a completed section of the concrete barrier 1. A space left by the removal of core 12 (not shown) is shown at 2. This space allows for drainage and for expansion of the sections of the barrier due to varying atmospheric conditions.

Inner core 17 is shown removed, leaving outer walls 15 and 16 in place before removal.

It should be noted that the remainder of the metal frame is completely embedded in the poured concrete.

It also should be noted that collpasable core 12 may be slightly taller and slightly wider than the rest of frame 1 in order to identify it after the concrete has been poured, while not being too much larger so as to interfer with the pouring of the barrier.

Figure 7:
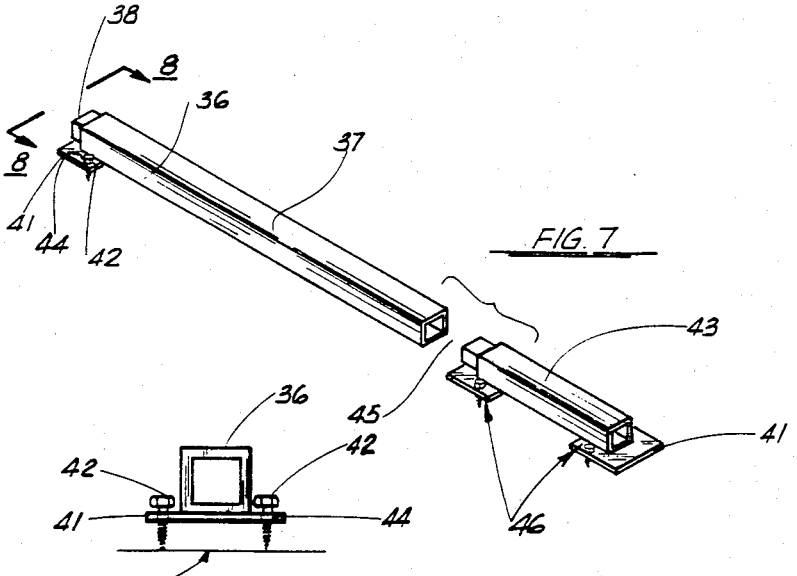
FIG. 7 is a perspective view of the contact connectable pipe guide used to guide the concrete pouring machinery.
Figure 8:
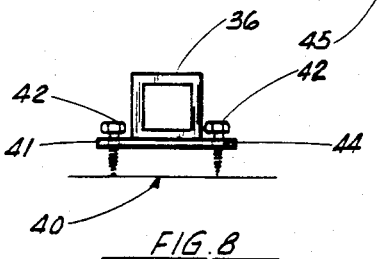
FIG. 8 is an end view of the contact connectable pipe guide taken along perspective lines 8—8 of FIG. 7.

FIG. 7 shows how the sections of contact connectable pipe may be used in order to provide a guide for the aluminum, electronically controlled arm of the concrete pouring machinery. Pipe section 36 provides a surface 37 which provides a guide for the aluminum arm of the concrete pouring machinery. Pipe sections 36 are hollow. One end of pipe sections 36 is provided with a separte, attached fitting 38. The fitting 38 is of such a size that it fits snugly without movement into the end of any other section of pipe 36 as indicated by the dotted line at 45. In this way, several sections of pipe may be connected together by 'plugging' the fitting 38 of one into the other end of another pipe thus forming a continuous guide. These pipe sections 36 may be five to ten feet long so as not to be too long to handle while being long enough so that the number of such sections 36 needed are not too great. The sections 36 may be one and one half inch square pipe in order to be heavy enough to rest firmly on the surface 40 while not being so heavy as to be difficult to handle.

These pipe sections 36 rest on metal plates 41 which may be four inches long, two inches wide and one half inch thick. Metal plates 41 have threaded holes cut into them 44 through which bolts 42 are screwably attached. By means of these bolts 42, the height of these pipe sections 36 may be controlled so as to hold the sections 36 at the proper height above the surface on which the concrete is to be poured 40.

Bolts 42 are provided on either side of the metal plates 41 so as to hold the metal pipes 36 at an even keel.

The end pipe section 43 may be fitted with a separate metal plate 41 so as to support it at both ends as shown at 46 in FIG. 7. The metal pipes 36 shown here are square pipe. This shape is only shown by way of example and the use of any other type of pipe is also envisioned.

Because many varying and different embodiments may be made within the scope of the inventive concept herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A system for constructing concrete barriers with spacing between sections of the barrier for proper drainage for the roadway and for expansion during changing atmospheric conditions, including the step of inserting a collapsable and removable core into the framework of the barrier at gaps in the framework left for this purpose before the pouring of the concrete which makes up the outer surface of the barrier; said framework and core comprising:

(a) a framework of rods or studs mounted in or on the surface on which the concrete barrier is to be built with pins positioned on the framework parallel to the ground at predetermined gaps in the framework, which pins stick into said gap a predetermined, set distance from either side of the framework on either side of the gap; and (b) a vertically disposed, collapsable core, movable as a rigid unit prior to insertion in the gap, mounted snugly against and between the pins on either side of the barrier in the general shape of the frame, said collapsable core being at least in part supported by said pins, which collapsable core comprises (i) a first, vertically disposed, extended, rigid sheet of material forming an outer surface facing the direction from which the concrete is to be poured, which surface fits snugly against said pins extending into the gap from the side of the framework from which the concrete is to be poured, said first surface being constructed of a material, such as plywood or steel, with enough strength to withstand the pressure of the concrete being poured without breaking or deforming;

(ii) a second, extended, rigid sheet of material forming an outer surface at least generally parallel to said first outer surface, facing away from the direction from which the concrete is being poured and located on the side of the collapsable core opposite said first outer surface, the outer surface of which fits snugly against the pins mounted on the side of the gap of the framework opposite the direction of the pouring of concrete; and (iii) at least one, vertically disposed, inner core member, the inner core member(s) extending at least about the full peripheral areas of said first and second surfaces, which inner core member(s) fit snugly against each other and against said first and said second outer surfaces about at least most of their extended, vertically disposed surfaces, the number and width of said inner core member(s) corresponding to the predetermined spacing desired between sections of the barrier, said first and said second outer surfaces with said core member(s) sandwiched between them forming a solid, rigid unit which can be moved about as a unit before being placed between said pins.

2. The system of claim 1, wherein said inner core member(s) of the collapsable core is of a fungible or breakable material, such as styrofoam, and is cut out after the concrete has been poured and dried and the two outer surfaces then collapsed into the space left by removing the inner core and then removed, leaving a space corresponding to the width of the collapsable core.

3. The system of claim 1, wherein said inner core member(s) is constructed of at least one metal plate or other hard material which is removed from the collapsable core by hammering it out after the concrete has dried.

4. The system of claim 1, further including positioning tool means for positioning said pins, said positioning tool means comprising a generally rectangularly shaped, structural, rigid piece which is of the same width as said collapsable core, said structure having an outline illustrated on either side of said structure of said collapsable core, the tool being insertable into the gaps in said framework and the pins being positioned on said framework by having them extend into the gap from either side of the framework until they touch the positioning tool on either side of said structural piece at points marked by the illustrated outline of said collapsable core illustrated on the sides of the positioning tool; after the pins have been placed, the positioning tool being removeable leaving a gap between the pins into which said collapsable core may be inserted and fitted snugly.

5. The system of claim 4, wherein said positioning tool further includes metal bands, one attached to the top and middle of the tool, and one attached to the side of the tool and along the surface on which the bottom of the tool rests, said bands meeting at an angle of approximately 45° at a slight distance from the tool itself and towards the side of the tool on which one of the metal bands is attached to form a sturdy support holding the tool upright, while not interfering with placing the tool into the gap where the pins are to be placed.

6. The system of claim 1, further including the step of cutting off all of the metal rods of the framework at the same height by attaching the head of an acetylene torch at a fixed height on a rod, which rod rests on the surface beside the rod to be cut, holding the torch head at the proper height for cutting.

* * * * *